United States Patent [19]

Cornelissens

[11] 4,210,550

[45] Jul. 1, 1980

[54] DETERGENT COMPOSITION CONTAINING AN ALKALI CARBONATE

[75] Inventor: Emery G. Ph. Cornelissens, Nootdorp, Netherlands

[73] Assignee: Akzo N.V., Arnhem, Netherlands

[21] Appl. No.: 924,552

[22] Filed: Jul. 14, 1978

[51] Int. Cl.[2] ..... C11D 3/10; C11D 3/20; C11D 17/00; C11D 17/04

[52] U.S. Cl. ..... 252/90; 252/100; 252/132; 252/142; 252/156; 252/174; 252/174.13; 252/174.14; 252/174.23; 252/174.24; 252/180; 252/350; 252/DIG. 3; 252/DIG. 2

[58] Field of Search ..... 252/89, 100, 132, 136, 252/142, 156, 174, 90, 91, 350, 174.13, 174.14, 174.23, 174.24

[56] References Cited

U.S. PATENT DOCUMENTS

| | | | |
|---|---|---|---|
| 3,042,621 | 7/1962 | Kirschenbauer | 252/99 |
| 3,661,787 | 5/1972 | Brown | 252/109 |
| 3,692,684 | 9/1972 | Hentschel | 252/89 |
| 3,696,044 | 10/1972 | Rutledge | 252/180 |
| 3,749,675 | 7/1973 | Chang | 252/135 |
| 3,761,415 | 9/1973 | Gould | 252/89 |
| 3,817,870 | 6/1974 | Weiss | 252/135 |
| 3,850,852 | 11/1974 | Neillie | 252/536 |
| 3,962,149 | 6/1976 | Chirash | 252/540 |
| 3,997,459 | 12/1976 | Bogie | 252/99 |
| 4,028,262 | 6/1977 | Cheng | 252/89 R |
| 4,110,262 | 8/1978 | Arnau | 252/545 |

*Primary Examiner*—Dennis L. Albrecht
*Attorney, Agent, or Firm*—Stevens, Davis, Miller & Mosher

[57] ABSTRACT

The present invention relates to a detergent composition containing one or more surfactants, an alkali carbonate and an acid, and in which detergent composition the acidic and the alkaline constituent are separately present, the acidic constituent having a higher rate of solubility in a wash liquor than the alkaline constituent, and the total amount of alkali being present in excess relative to the amount of acid. Characteristic of the invention is that the acidic constituent of the detergent composition contains 5 to 30 per cent by weight, calculated on the total amount of detergent composition, of one or more acids having the formula:

$$HOOC—(CH_2)_n—COOH,$$

where n is 2,3, or 4

It is preferred that the acidic constituent should contain a mixture consisting of 20 to 40 per cent by weight of adipic acid, 20 to 40 per cent by weight of succinic and 20 to 60 per cent by weight of glutaric acid.

3 Claims, No Drawings

DETERGENT COMPOSITION CONTAINING AN ALKALI CARBONATE

The invention relates to a detergent composition containing one or more surfactants, an alkali carbonate, and an acid, and in which detergent composition the acidic and the alkaline constituent are separately present, the acidic constituent having a higher rate of solubility in a wash liquor than the alkaline constituent, and the total amount of alkali being present in excess relative to the amount of acid. A detergent composition of the type indicated above is known from U.S. Pat. No. 3,761,415.

Said patent specification describes a phosphate-free detergent composition consisting of a substance which can release citrates, such as citric acid, alkali carbonate, and a synthetic surfactant. In essence, the citrate ions go into solution before the sodium carbonate and in such an amount that the formation of water-insoluble calcium carbonates and magnesium carbonates is inhibited. The formation of a precipitate is prevented in that the calcium ions and the magnesium ions are present in the wash liquor in the form of citrate complexes.

The compositions described in the above-mentioned patent specification has the disadvantage, however, that a relatively high weight percentage of citrates need be incorporated into it to prevent the above-mentioned precipitation. At a German Hardness of 6° the wash liquor should preferably contain 0.5 percent by weight of citric acid and 1.0 percent by weight of alkali carbonate. Converted for a composite product, the detergent compositions given in the examples contain 33 to 57 percent by weight of citric acid. For reasons of economy, partly because of the relatively high cost price of citrates and citric acid, such a percentage is unacceptably high. Moreover, even at low initial hardness values the remaining hardness appears to be relatively high, which for instance unfavourably affects the envisaged cleaning effect.

Moreover, it has been found that the use of citric acid, particularly at the high concentrations described in the above-mentioned patent specification, may give rise to corrosion on the inside of a washing machine. The detergent composition according to the present invention does not show these drawbacks and is characterized in that the acidic constituent contains 5 to 30 percent by weight, calculated on the total amount of detergent composition, of one or more acids having the formula:

$$HOOC-(CH_2)_n-COOH,$$

where n is 2,3 or 4

The present invention provides a solution to the problem of excluding from a detergent composition those components that are (may be) harmful from an ecological point of view. As examples of such possibly harmful components may be mentioned the frequently employed sodium polyphosphate and other phosphates. Phosphates form an indispensable nutrient for vegetable and animal life. When present in high concentrations in stagnant or slowly flowing water, however, they may give rise to excessive growth of algae. One of its consequences is a decrease of the oxygen content in the deeper parts of the water, and anoerobic processes may cause the formation of gases such as methane and carbon disulphide. These phenomena may have a detrimental influence on fish-stock and may cause considerable damage to areas of natural beauty and recreation.

In view of the severity of the above problem there has in the last few years been an intensive search for suitable substitutes for phosphates in detergent compositions. The phosphates are added to the detergent because they are capable for instance of binding calcium ions and magnesium ions to form soluble complexes. As a result, these ions can no longer form objectionable precipitates along with ingredients of the wash liquor or with dirt held by the fabric to be laundered. These precipates are objectionable in that they deposit on the laundered fabric. Substitutes for phosphate that have been proposed include oxidized polysaccharides, certain cellulose derivatives, citrates, nitrilotriacetates and water-insoluble sodium aluminosilicates. Total replacement of phosphates has so far been realized only on a limited scale.

According to the invention the above problem can be solved in an inexpensive way by the use of a detergent composition based on alkali carbonate. The conventional detergent compositions based on alkali carbonate have the disadvantage that in successive washing cycles they give rise to considerable growth of water-insoluble carbonates on the fabric being cleansed. This drawback is still aggravated in that such incrustation is cumulative and may increase more than proportionally as a function of the number of washing cycles. As a result, the quality of the fabric treated with these compositions will be affected and the fabric will display little absorption power and have a stiff and hard handle; moreover, wear and discoloration will occur. Besides, as a result of aging, the carbonate precipitate will become more and more difficult to dissolve.

It has been found, however, that in one washing cycle so little fabric incrustation occurs that the above-mentioned drawbacks are not met. The use of the detergent composition according to the invention results in the fabric incrustation formed in one washing cycle being brought into solution at the beginning of the next washing cycle by a reaction with acid under mildly acid conditions. The mildly acid conditions should be maintained sufficiently long to allow the precipitated carbonates to practically completely dissolve.

Subsequently, as a result of the alkaline constituent going into solution, the wash liquor is softened. For the presence of the alkali carbonate in the water causes the calcium ions and the magnesium ions contained in the wash liquor to be precipitated as water-insoluble carbonates. For maximum softening and optimum washing effect the pH of the wash liquor, after almost complete dissolution of the alkaline constituent, should have a value in the range of 9.0 to 10.5.

Application of the present invention prevents appreciable growth in a fabric of insoluble carbonates or other salts. Moreover, there is only need to use a relatively low percentage by weight of acid, calculated on the total amount of detergent composition. It should be added that the German Patent Specification No. 2,437,173 describes a process which comprises successive treatments with an acidic pre-wash detergent composition and an alkaline main-wash detergent composition based on sodium carbonate. The present invention has the advantage over that according to said German Patent Specification No. 2,437,173 that the envisaged prevention of appreciably cumulative incrustation is realized by the use of a single detergent composition. Moreover, when use is made of the present detergent composition it is unnecessary and mostly even undesirable for the wash liquor entirely or largely to be drained off between the acid and the akaline phase of the washing process.

The acidic constituent should contain 5 to 30 percent by weight, calculated on the total amount of detergent composition, of one or more acids having the formula $$HOOC-(CH_2)_n-COOH,$$

where n is 2,3 or 4. These acids appear to have a minimum agressive effect on the washing and to give no or hardly any rise to corrosion.

The amount of acid should be sufficiently high to dissolve calcium carbonate and magnesium carbonate in a fabric. The required percentage by weight of acid is dependent, inter alia, on the acid used, the bicarbonate content and the hardness of the water employed for the washing treatment. In practice it has been found that an amount of 5 to 30 percent by weight, calculated on the total amount of detergent composition, is sufficient.

One or more of the acids of the above formula may be mixed with inorganic acids such as sodium bisulphate. In combination with other acids use may also be made of polycarboxylic acids, such as polyacrylic acid, the acid form of oxidized cellulose and starch, mono- and polycarboxylated products obtained by substitution of hydrogen atoms of starch and cellulose, such as carboxymethyl cellulose and dicarboxymethyl starch. It is preferred that the acidic constituent should contain a mixture of acids consisting of 20 to 40 percent by weight of adipic acid, 20 to 40 percent by weight of succinic acid and 20 to 60 percent by weight of glutaric acid. It has been found that this acid mixture has a relatively high rate of solubility in the wash liquor and moreover favourably influences the rate at which the precipitated carbonates go into solution during the acidic phase of the washing process.

Preference is given to the use of detergent compositions in which such a mixture is included in the acidic constituent also because of the relatively low cost price of said mixture.

Depending on the envisaged application of the detergent composition one or more conventional components may be incorporated into the acidic constituent.

By preference the acidic constituent contains a surfactant. Its presence results in the acid, the washing and the precipitated carbonates being wetted more rapidly, which favourably influences the rate of solubility of the carbonates. Particularly suitable for this purpose are ethoxylated fatty alcohols.

Another category of materials that may be incorporated into the acidic constituent are per-compounds such as peroxides, which have an optimum bleaching effect at a pH lower than that at which the detergent composition displays optimum cleaning action. Also compounds such as peroxomonosulphate, which have insufficient storage stability in the usual detergent compositions, may be included in the acidic constituent.

The alkaline constituent should contain such an amount of alkali that after the alkaline constituent has almost completely dissolved the pH of the wash liquor is 9.0–10.5. This pH is required for obtaining an optimum cleaning effect and effective softening. By preference, the alkali used is an alkali carbonate or a mixture of alkali carbonate and, for instance, sodium silicate. The alkali content may vary between wide limits. The detergent composition should however contain at least 5 percent by weight of alkali carbonate in order that the calcium ions and the magnesium ions may be precipitated in the wash liquor. A lower percentage would be ineffective even under the most favourable conditions. In some circumstances it may be desirable for the detergent composition to contain as much as 65 percent by weight of alkali carbonate.

A suitable alkali carbonate is sodium carbonate. Sodium carbonate and its hydrates, however, are relatively sensitive to moisture. With the present detergent composition this may lead to difficulties in that this detergent composition contains an acidic as well as an alkaline constituent. Also the rather high alkalinity sometimes form a drawback. For these reasons in addition to calcined sodium carbonate and alkaline constituent may be made to contain as alkali carbonate sodium bicarbonate and/or sodium sesquicarbonate. These combinations of compounds are less sensitive to moisture than sodium carbonate and also have a lower alkalinity.

Moreover, the alkaline constituent may contain one or more usual detergent components such as surfactants, builders, bleaching agents, fluorescent brighteners, enzymes, foaming agents, substances such as sodium carboxymethyl cellulose, which serve to prevent dirt from re-depositing on the fabric, bactericides, corrosion inhibitors, perfumes, colourants, etcetera.

As surfactants may by used the water-soluble salts of higher fatty acids ("soaps") of the synthetic surfactants described in, for instance, the British Patent Specifications Nos. 1,429,143 and 1,473,201.

It is preferred that the surfactant contained in the alkaline constituent should be an alkyl ether sulphate. Alkyl ether sulphates have the advantage that they contribute to reducing incrustation. Preferably use is made of sodium tallow fatty alcohol ether sulphate. The retarded dissolution of the alkaline constituent may be obtained in various ways.

For example, use may be made of known shaping techniques, which are grouped here under the generic name of agglomeration techniques. By agglomeration techniques are to be understood, inter alia, pelletizing, tabletting, granulating, extruding, marumerizing, briquetting, rolling followed by cutting. In this way also the surface area of the alkaline constituent is drastically reduced, which is of course of importance for the present invention.

The most important parameters influencing the rate of solution are the composition of the alkaline constituent, the shaping method and the shaping pressure that may be used. It is preferred that the alkaline constituent should be provided with a coating which does not disintegrate until after at least 2 and at most 10 minutes and preferably after at least 3 and at most 6 minutes. By disintegration are to be understood here, inter alia, dissolution and dispersion.

The amount of coating material to be used is 0.1–15, and preferably 0.5–10 percent by weight, calculated on the total amount of detergent composition. As coating material may be used any material known to be employed for the present purpose.

As examples of suitable water-soluble or water-dispersable polymers may be mentioned polyethylene glycols, polyvinyl glycols, polyvinyl alcohol, polyvinyl pyrrolidone, polyvinyl acetate, carboxymethyl cellulose, carboxmethyl starch, hydroxypropyl cellulose, gelatin, arabic gum, etcetera, provided that they are applied in a sensible manner. Excellently suitable are (co)polymers of methacrylic acid and methacrylic esters, available under the trade names Eudragit L 30 D and E 30 D.

The acidic and the alkaline constituent should be separately present in the detergent composition. To this end it is only required that the two constituents can be separately distinguished. This requirement consequently does not exclude the two constituents from being in contact with each other. The acidic constituent in the form of a powder may be directly mixed with the alkaline constituent. Just as the alkaline constituent, however, it also may be agglomerated. The detergent composition according to the invention also may be obtained by still entirely or partly providing the coated alkaline constituent with a coating of the acidic constituent. In this way demixing of the detergent composition during storage is prevented.

It is preferred that the detergent composition should be brought into the form of a feed unit comprising a sachet entirely or partly made of a material permeable to or disintegrating in water and filled with the acidic and the alkaline constituent. In this way the acid is prevented from getting into contact with the washing before it dissolves. As a result, even the slightest chance of fibre damage and discoloration of the washing is avoided. Such a sachet may consist of a material which does not disintegrate in water and is closed with a strip of material which does disintegrate in water.

Alternatively, the sachet may be closed by means of seams joined with a material that disintegrates in water. As examples of suitable materials that do not disintegrate in water may be mentioned polyethylene, polypropylene and polyvinyl chloride. To close the sachet use may be made of water-dispersible paper.

By preference, however, the sachet consists entirely or partly of a non-woven material. This material is permeable to water and relatively strong.

A sachet is filled with an amount of detergent composition which is sufficient for one washing cycle. The filled sachet can therefore be brought into the wash liquor as such. It is preferred that the detergent composition should be in a form such that there is no direct contact between the acidic and the alkaline constituent. To that end a sachet of the type indicated above may be filled with an acidic and an alkaline constituent, the latter constituent being provided with a coating which disintegrates in water only after at least 2 and at most 10 minutes and preferably after at least 3 and at most 6 minutes.

It is preferred, however, that the detergent composition should be brought into the form of feed unit such that the sachet has two compartments, the acidic constituent being contained in the one and the alkaline constituent in the other comparment. Such a feed unit comprises for instance a sachet consisting of 2 non-woven outer walls and a polyethylene partition wall, the one compartment being filled with a powdered acidic constituent and the other compartment with a coated alkaline constituent. The seams of these sachets may be sealed with a glue or by using pressure at elevated temperature.

Or the sachets may be so formed that the alkaline constituent goes into retarded dissolution as a result of the construction of the sachet. The use of such sachets has the advantage that the alkaline constituent may be contained in the sachet in the form of powder. To that end a sachet may be made of which the compartment containing the alkaline constituent (the "alkaline" compartment) entirely or partly consists of a material which becomes permeable to water or disintegrates only after at least 2 and not more than 10 minutes and preferably after at least 3 and not more than 6 minutes.

By disintegration is also to be understood here tearing of the sachet. A sachet may in principle consist of for instance, 3 layers of material, the outer wall of the "acidic" compartment being permeable to water, the outer of the "alkaline" compartment being impermeable to water and the partition wall for instance consisting of a mixture of poly(meth)acrylic acid (Eudragit L 30 D) polymethacrylic esters (Eudragit E 30 D) and polypropylene glycol, or a mixture of polymethacrylic esters (Eudragit E 30 D) and hydroxypropyl methyl cellulose.

The water-permeable outer wall preferably consists of a non-woven material. For the water-impermeable wall various materials may be used. By preference however use is made of polyethylene, polypropylene, polyvinyl chloride or a non-woven material provided with a water-insoluble coating.

Alternatively, the "alkaline" compartment may be closed with a strip which becomes permeable to water or disintegrates after at least 2 and not more than 10 minutes and preferably after at least 3 and not more than 6 minutes. Such a strip may be provided as connecting strip between an impermeable partition wall and outer wall. Such a strip may for instance entirely or partly consist of a mixture of polymethacrylic acid (Eudragit L 30 D), polymethacrylic esters (Eudragit E 30 D) and polypopropylene glycol, or of a mixture of polymethacrylic esters and hydroxypropyl methyl cellulose. Alternatively, the alkaline compartment may be provided with one or more seams that open in water after at least 2 and not more than 10 minutes and preferably after 3 and not more than 6 minutes. A sachet of this type may be made by providing in the seams a material which disintegrates in water within the above-mentioned period.

For example, the seams of the sachet may entirely or partly be filled with a mixture of polyethylene glycol one or more thermoplastic acrylic resins and a highly disperse silicium oxide. The seams of such a sachet will open after 4-5 minutes at a wash temperature of 55° C.

The invention is further described in the following examples.

EXAMPLE I (COMPARATIVE)

The following bundle tests were carried out in a Wringer washing machine, The volume of the wash liquor was 50 liters, the water had a German Hardness of 7.5°. 2.95 kilogrammes of washing consisting of napkins, bath towels, tea towels and parts of bed sheets were washed 20 times. The washing tests were carried out both at room temperature and at 55° C. To the wash liquor there were added 83.4 grammes of a traditional detergent composition based on sodium carbonate. The detergent composition contained the following ingredients:

1.8 grammes of tallow fatty alcohol, 25 ethylene oxide
7.0 grammes of tallow fatty ether sulphate
5.0 grammes of sodium dodecyl benzene sulphonate
10.0 grammes of sodium disilicate
11.8 grammes of sodium carbonate
21.5 grammes of sodium bicarbonate
1.0 gramme of sodium carboxymethyl cellulose
23.0 grammes of sodium sulphate
2.3 grammes of water Of each type of washing the incrustation was determined before starting the washing tests, and after the 10th and the 20th washing cycles, Table I shows the results obtained after washing at room temperature. Table II gives the results obtained after washing at 55° C.

Table I

| Number of washing cycles | Percentage incrustation in the washing | | | | |
|---|---|---|---|---|---|
| | napkins | sheets | bath towels | tea towels | average |
| 0 | 0,19 | 0,21 | 0,42 | 0,21 | 0,26 |
| 10 | 0,63 | 0,54 | 1,02 | 1,01 | 0,80 |
| 20 | 1,19 | 1,08 | 1,72 | 1,54 | 1,38 |

Table II

| Number of washing cycles | Percentage incrustation in the washing | | | | |
|---|---|---|---|---|---|
| | napkins | sheets | bath towels | tea towels | average |
| 0 | 0,19 | 0,21 | 0,42 | 0,21 | 0,26 |
| 10 | 0,48 | 0,49 | 1,87 | 0,66 | 0,88 |
| 20 | 0,88 | 0,96 | 2,31 | 1,27 | 1,35 |

The above results show that when use is made of the traditional detergent compositions based on alkali carbonate, there will be considerable accumulation in the washing of insoluble calcium carbonates and magnesium carbonates.

EXAMPLE 2

The following washing tests were all carried out at 55° C. under the conditions described in Example 1. Instead of a traditional detergent composition based on alkali carbonate a feed unit of the detergent composition recording to the invention was added to the wash liquor.

The feed unit comprised a 2-compartment sachet measuring 15×12 cm having an outer wall of the "alkaline" compartment of a laminated non-woven material, and an outer wall of the "acidic" compartment of a non-woven material and a partition wall of polyethylene. The seams were sealed with glue. On one side of the sachet a tear strip was provided between the outer wall of the alkaline compartment and the partition wall, which tear strip was about 0.07 mm thick and tore after 5 minutes at a wash liquor temperature 55° C. The strip consisted of 5 parts of Eudragit E 30 D and 0,25 parts of Methocel H G 100 (hydroxyl propyl methyl cellulose). The sachet was filled with 22.4 grammes of acid and 69.0 grammes of alkaline constituent.

The acidic constituent was present in the form of extrudates having a diameter of 0.8 mm and a length of 1 to 3 mm; the alkaline constituent was present in the form of powder. The acidic constituent was made up of:

6.2 grammes of adipic acid
6.2 grammes of succinic acid
8.3 grammes of glutaric acid
1.7 grammes of tallow fatty alcohol, 25 ethylene oxide The alkaline constituent was made of:

7.0 grammes of tallow fatty ether sulphate
5.0 grammes of sodium dodecyl benzene sulphonate
10.0 grammes of sodium silicate
39.0 grammes of sodium carbonate
1.0 gramme of sodium carboxymethyl cellulose
7.0 grammes of water During each washing cycle the pH of the wash liquor was measured after 5 and 15 minutes.

The results are shown in the following table.

Table III

| Number of washing cycles | pH after 5 minutes | pH after 15 minutes |
|---|---|---|
| 1 | 4,1 | 10,2 |
| 5 | 4,6 | 10,2 |
| 10 | 4,7 | 10,2 |
| 15 | 4,8 | 10,2 |
| 20 | 4,7 | 10,2 |

The relation between pH of the wash liquor and time during the 20th washing cycle is given in the following Table IV.

| Time (in minutes) | pH |
|---|---|
| 2 | 4,7 |
| 4 | 4,7 |
| 5 | 4,7 |
| 6 | 10,2 |
| 8 | 10,2 |
| 15 | 10,2 |

Also in these washing tests the incrustation was determined before starting the washing tests, and after the 10th and the 20th wash cycles. The results are given in the following Table V

| Number of washing cycles | Percentage incrustation in washing | | | | |
|---|---|---|---|---|---|
| | napkins | sheets | bath towels | tea towels | average |
| 0 | 0,19 | 0,21 | 0,41 | 0,21 | 0,26 |
| 10 | 0,08 | 0,12 | 0,42 | 0,23 | 0,21 |
| 20 | 0,18 | 0,17 | 0,43 | 0,31 | 0,27 |

The above bundle test shows that use of the present invention hardly leads to any incrustation. It also appeared that the primary cleansing effect of the detergent composition according to the invention compares with that of the phosphate-containing detergent compositions.

No fibre damage was found. Nor did the washing show any appreciable discoloration.

EXAMPLE 3

The following experiment was carried out under the conditions described in Example 1.

The acidic constituent of the detergent composition was in the form of a powder and was made up of the same ingredients as indicated in Example 2, and the alkaline constituent described in Example 2 was formed into spherical particles of an average diameter of about 1 mm by extruding and marumerizing. These spherical particles were coated with 2.5% by weight of Eudragit E 30 D and 10% by weight of Eudragit L 30 D. The amount of coating material was 9.4% by weight, calculated on the total amount of detergent composition. The detergent composition was added to the wash liquor in an amount of 95 grammes.

The following table shows the relationship between pH and time during the first washing cycle. The wash liquor temperature was 55° C.

Table VI

| time in minutes | pH |
|---|---|
| 1 | 4,2 |
| 2 | 4,4 |
| 3 | 5,7 |
| 4 | 7,3 |

Table VI-continued

| time in minutes | pH |
|---|---|
| 5 | 9,6 |
| 6 | 10,1 |
| 8 | 10,2 |
| 10 | 10,2 |

After 10 and 20 wash cycles the average incrustation values were 0.23% and 0.28%, respectively.

The above data confirm the results described in Example 2.

What is claimed is:

1. A detergent composition containing 5–30 percent by weight of one or more surfactants, 5–80 percent by weight of an alkali carbonate, and an acid, the acidic constituent and the alkaline constituent being separately present in the composition, said acidic constituent dissolving in a wash liquor at an earlier moment than the alkaline constituent, and the total amount of alkali being present in excess relative to the amount of acid, characterized in that the acidic constituent contains 5 to 30 percent by weight, calculated on the total amount of detergent composition, of a mixture consisting of 20 to 40 percent by weight of adipic acid, 20 to 40 percent by weight of succinic acid and 20 to 60 percent by weight of glutaric acid.

2. The detergent composition of claim 1 characterized in that the alkaline constituent is provided with a coating which disintegrates in water only after at least 2 and at most 10 minutes.

3. The detergent composition according to claim 2 characterized in that the coating disintegrates in water only after at least 3 minutes and at most 6 minutes.

* * * * *